US011523973B2

(12) United States Patent
Bailey et al.

(10) Patent No.: US 11,523,973 B2
(45) Date of Patent: Dec. 13, 2022

(54) CAPSULE FILLER

(71) Applicant: 3P Innovation Limited, Warwick (GB)

(72) Inventors: Thomas Bailey, Warwick (GB); Andrew Cleall, Warwick (GB)

(73) Assignee: 3P Innovation Limited, Warwich (GB)

( * ) Notice: Subject to any disclaimer, the term of this patent is extended or adjusted under 35 U.S.C. 154(b) by 0 days.

(21) Appl. No.: 16/466,421

(22) PCT Filed: Dec. 5, 2017

(86) PCT No.: PCT/GB2017/053658
§ 371 (c)(1),
(2) Date: Jun. 4, 2019

(87) PCT Pub. No.: WO2018/104720
PCT Pub. Date: Jun. 14, 2018

(65) Prior Publication Data

US 2019/0328614 A1 Oct. 31, 2019

(30) Foreign Application Priority Data

Dec. 5, 2016 (GB) ..... 1620628

(51) Int. Cl.
*A61J 3/07* (2006.01)
*B07C 5/34* (2006.01)

(52) U.S. Cl.
CPC ..... *A61J 3/074* (2013.01); *B07C 5/3408* (2013.01); *A61J 2200/74* (2013.01)

(58) Field of Classification Search
CPC .... B65B 1/04; B65B 1/06; B65B 1/20; B65B 1/32; B65B 1/34; B65B 1/46; B65B 7/28;
(Continued)

(56) References Cited

U.S. PATENT DOCUMENTS 3,847,191 A 11/1974 Aronson
5,797,248 A * 8/1998 Hetherington ..... A61J 3/075 141/247

(Continued)

FOREIGN PATENT DOCUMENTS

EP 2851303 B1 * 9/2014 ..... B65B 1/46
EP 2851303 A1 * 3/2015 ..... G01G 23/06

(Continued)

OTHER PUBLICATIONS

PCT International Search Report for International Application No. PCT/GB2017/053658, dated Mar. 29, 2018,4 pages.

(Continued)

*Primary Examiner* — Andrew M Tecco
*Assistant Examiner* — Jacob A Smith
(74) *Attorney, Agent, or Firm* — J. Miguel Hernandez; James R. Gourley; Carstens, Allen & Gourley, LLP

(57) ABSTRACT

There is described apparatus for filling a material into a receptacle, said apparatus comprising: (i) a material; (ii) a receptacle handling unit comprising a pair of axially aligned bushes for collecting a receptacle; and (iii) a bush pair handling system comprising: (a) a means for separating the receptacle into a receptacle body and a receptacle closure; (b) means for temporarily attaching and detaching the one or both of the bushes from the bush pair handling system; (c) means for transporting the receptacle body to the filling station and aligning the receptacle body with a filler nozzle at the filling station; (d) means for transporting the filled receptacle body from the filling station to a closure unit for refitting the receptacle closure; and e) means for segregating compliant receptacles from non-compliant receptacles.

20 Claims, 2 Drawing Sheets

Figure 1:
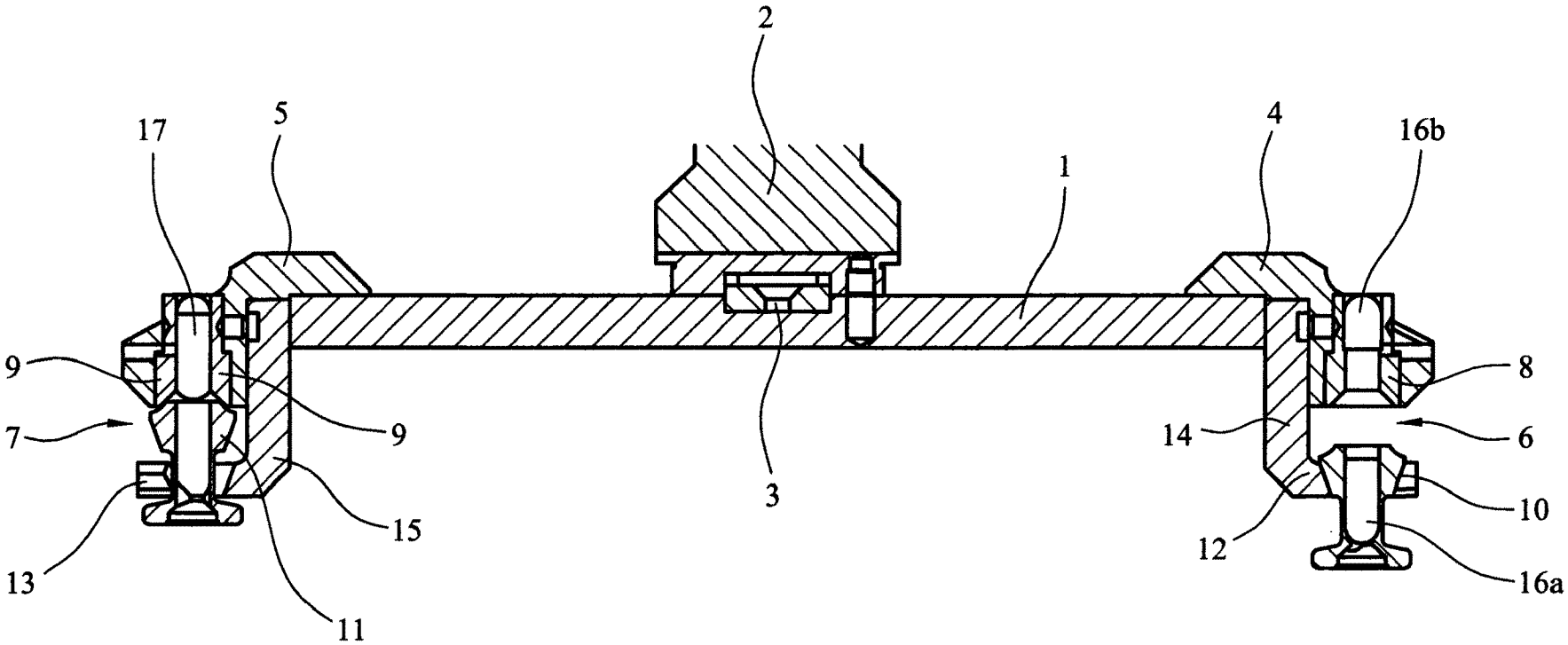

(58) Field of Classification Search
CPC ..... B65B 7/2807; B65B 43/42; B65B 43/50; B65B 43/48; B65B 43/52; B65B 43/54; B65B 43/56; A61J 3/07; A61J 3/074; A61J 2200/74
USPC ..... 53/253, 281, 282, 283, 284, 285, 287, 53/291, 295, 299, 471, 560
See application file for complete search history.

(56) References Cited

U.S. PATENT DOCUMENTS 7,640,953 B2 * 1/2010 Ansaloni ..... A61J 3/074 141/147
7,677,016 B2 * 3/2010 Trebbi ..... B65B 1/48 53/560
7,726,102 B2 * 6/2010 Gamberini ..... B65B 1/32 53/471
10,023,332 B2 * 7/2018 Gamberini ..... A61J 3/074
2008/0127609 A1 * 6/2008 Tagliavini ..... G01G 23/3735 53/53
2008/0256908 A1 * 10/2008 Frabetti ..... A61J 3/074 53/502
2009/0014086 A1 * 1/2009 MacMichael ..... B65B 1/22 141/71
2011/0146843 A1 * 6/2011 Ansaloni ..... B65B 5/103 141/369
2011/0259468 A1 * 10/2011 Bedetti ..... A61J 3/074 141/1
2013/0126041 A1 * 5/2013 Bailey ..... B65B 1/06 141/83
2013/0206484 A1 * 8/2013 Consoli ..... G01G 13/026 177/1
2015/0204714 A1 * 7/2015 Boehringer ..... G01G 17/00 53/281

FOREIGN PATENT DOCUMENTS

EP 2851303 A1 3/2015
WO 2012/004606 A2 1/2012

OTHER PUBLICATIONS

PCT Written Opinion of the International Searching Authority for International Application No. PCT/GB2017/053658, dated Mar. 29, 2018, 7 pages.

* cited by examiner

CAPSULE FILLER

CROSS REFERENCE TO RELATED APPLICATIONS

This is the national phase under 35 U.S.C. § 371 of International Application No. PCT/GB2017/053658, filed on Dec. 5, 2017, which claims priority to and the benefit of United Kingdom Patent Application No. 1620628.6, filed on Dec. 5, 2016, the entire disclosures of each of which are incorporated by reference herein.

FIELD OF THE INVENTION

The present invention relates to apparatus and methods for filling of liquid or solid particulate materials into receptacles.

More particularly, the present invention relates to apparatus for filling pharmaceutical dosage forms, such as, soft or hard gelatin capsules, with pharmaceutically active formulations, usually in the form of liquid or solid particulate materials, e.g. powders, granules or pellets, especially for use as pharmaceuticals. The present invention also relates to methods related thereto.

BACKGROUND TO THE INVENTION

Capsule filling machines or encapsulation machines are commonly used, especially in the pharmaceutical industry, for filling empty soft or hard gelatin capsules with pharmaceutical formulations. Such pharmaceutical formulations may be in the form of solid particulate materials, such as powders, granules, pellets and the like.

Hard or soft gelatin capsules generally comprise two parts, a body and a cap. Capsule filling machines usually operate by first separation the caps from bodies; filling a volumetrically measured dose of the formulation into the separated body of the capsule of the gelatin capsules; re-joining the capsules, i.e. conjoining the capsule cap and body; and then ejection of the filled capsule from the capsule filling machines.

In addition, automated capsule filling machines will usually also comprise the ability to reject bad gelatin capsules, i.e. capsules which are broken or which are not paired, i.e. do not comprise a body and a cap.

Manual, hand operated capsule filling machines are known and are generally used in hospitals or pharmacies.

In the manufacture of pharmaceuticals, automated capsule filling machines are widely used. Modern capsule filling machines generally comprise a rotary carousel equipped with a plurality of operating stations for processing the capsules.

The filling method usually consists of the steps opening the empty capsules at a station where the capsule bodies are separated from the caps to form two separate rows of bodies and caps; filling a volumetrically metered quantity of the pharmaceutical formulation into each capsule body at a filling station; and closing each filled capsule by applying a cap to the respective body.

U.S. Pat. No. 3,847,191 describes the dispensing of metered amounts of material by compressing the powder material, typically by application of a vacuum in a trough, followed by insertion of a filling gun within the compacted material to gather an amount of the compacted material followed in turn by dispensing such amount in a respective capsule.

However, such machines generally suffer from dose variation in the receptacles, particularly when filling a wide range of solid products having a wide range of packing densities and/or physical characteristics making handling difficult, such as shear sensitive materials. Consequently, this may cause capsules being filled with different amounts of a formulation. This is particularly undesirable when the capsules are filled with dose sensitive pharmaceutical formulations that must be administered at a precise predetermined dose.

U.S. Pat. No. 7,677,016, attempts to solve some of the above problems by volumetric measurements made during the filling step and by weighing capsules after they have been filled. However, such systems do not address the problem of dose variation that may occur during the filling step.

Therefore there still remains a need for a new apparatus and process for accurate and consistent filling of receptacles with a wide range of liquid or solid fill materials.

SUMMARY OF THE INVENTION

We have now found a device that overcomes or mitigates the problems associated with the prior art devices. More particularly, the present invention provides a receptacle filling system which provides accurate real time weight control of the material being filled into the receptacle.

Thus, according to a first aspect of the present invention there is provided an apparatus for filling a material into a receptacle, said apparatus comprising:

(i) a material reservoir (28) for containing an amount of the material to be filled and a filling station adjacent the material reservoir;

(ii) a receptacle handling unit comprising a pair of axially aligned bushes for collecting a receptacle from a receptacle reservoir, wherein the receptacle comprises a receptacle body and receptacle closure; and (iii) a bush pair handling system comprising:

(a) a means for separating the receptacle into a receptacle body and a receptacle closure, said means comprising a pair of mating bushes provided with axially aligned bores, wherein the mating bushes are capable of independently handling the receptacle body and receptacle closure by being separated into a body bush and closure bush;

(b) means for temporarily attaching and detaching the one or both of the bushes from the bush pair handling system;

(c) means for transporting the receptacle body to the filling station and aligning the receptacle body with a filler nozzle at the filling station;

(d) means for transporting the filled receptacle body from the filling station to a closure unit for refitting the receptacle closure; and e) means for segregating compliant receptacles from non-compliant receptacles.

The pair of mating bushes will generally comprise a male bush and a female bush. In a preferred aspect of the invention the male bush is the body bush and the female bush is the closure bush.

The means for segregating compliant receptacles, e.g. accurately filled receptacles, from non-compliant receptacles, e.g. damaged or inaccurately filled receptacles, will generally comprise positioning the filled receptacle (in its body bush) on a weigh cell, capable of determining whether a receptacle is compliant or non-compliant; and transporting the body bush containing the receptacle adjacent to a respective hopper where the receptacle is ejected from the body bush into a compliance hopper or non-compliance hopper as appropriate. Means for ejecting the receptacle from the body bush may comprise one or more ejections posts, such that the body bush can be depressed against the one or more ejections posts, urging the receptacle from body bush.

In one aspect of the invention it is preferred that it is the body bush that is temporarily attached and/or detached from the bush pair handling system.

The material to be filled into the receptacle may be a liquid or a solid particulate material, e.g. in the form of powder, granules, pellets and the like. The material may also be combinations of forms of solid or liquid materials. The material may especially comprise a pharmaceutical material. It will be understood that the filling station may measure a dose of material to be filled into the receptacle gravimetrically or volumetrically, depending, inter alia, upon the nature of the material, etc. In one particular aspect of the invention the filling station measures the dose gravimetrically, for example, using real time weight control, such as the Fill2Weight™ process described in European Patent application No. 2590862 (WO 2012/004606).

Thus, according to this aspect of the invention there is provided an apparatus for filling a material into a receptacle, as herein described, in combination with a material filler for accurately filling particulate material, for example a pharmaceutical substance, into a receptacle, the material doser comprising a hopper with a tip having an aperture through which powder may flow, a closure to close the aperture and a vibration device configured to agitate the hopper, wherein a first portion of the hopper is formed of flexible material and a second portion proximate the tip is formed of substantially rigid material.

Desirably, the means transporting the receptacle to and from a filling station is automated, for example, the means may comprise a robotic arm which may be remotely controlled and/or computer controlled. Such a robotic arm will be provided with at least one bush pair holder which is aligned with at least one bush pair, such that, the bush pair is capable of being separated in order to open the receptacle and/or re-associated enabling the receptacle to be reclosed. If the receptacle is a conventionally known gelatin capsule, then the body of the capsule will be retained in the body bush and the cap or closure of the capsule will be retained in the closure bush, which remains fixed to the receptacle holder. Although it will be understood that it is within the scope of the present invention for the body of the capsule to be retained in closure bush and the cap retained in the body bush.

The bushes may comprise a low friction material, such as a thermoplastic polyethylene, e.g. UHMWPE or a low friction coated material In a further embodiment, the robotic arm may be provided with a plurality of bush pair holders and bush pairs. In a particular embodiment the robotic arm may be provided with a rotatory shaft rotatably connected to an extension arm, such that the extension arm is provided with a bush holder and receptacle holder at each end. Thus, the robotic arm may be provided with a pair of bush holders and receptacle holders or a plurality of pairs of bush holders and receptacle holders, e.g. 4, 6, 8, 10, or more bush holders and two part bush assemblies.

When the robotic arm is provided with one or more pairs of bush holders and receptacle holders the rotatable extension arm can be rotated about the shaft, providing dual bush exchange or dual receptacle filling, thus allowing parallel processing of the receptacle. This significantly speeds the filling process allowing filling rates of from about 100 to about 1,000 receptacles per hour to be filled.

Increasingly, patients are required to take more than one medicine and this is especially the case in the treatment of bronchial disorders with respiratory drugs. For example, combination therapies such as a steroid with a β2 agonist, e.g. fluticasone and salmeterol, have been commercially successful. Therefore, according to a further aspect of the invention, the robotic arm may be capable of visiting more than one filling site. Such an arrangement is particularly advantageous when it is desired to fill a receptacle with a combination therapy comprising more than one active ingredient.

Desirably, the body bush is designed to be only loosely held in the bush pair holder so that the body bush may be moved longitudinally and axially whilst being retained in the bush holder. This enables the receptacle to be inserted in, closed or ejected, from the bush pair Thus, in one embodiment the bush holder, for example, is located at the end of the extension arm, and may comprise a fork capable of being located about the body bush which allows the detachment of the bush from the extension arm. In this embodiment the bush pair comprises a bush body and is desirably provided with a circumferential shoulder, such that the fork at the end of the extension arm may wrap around the bush body and engage with the circumferential shoulder, enabling the bush to be located and lifted.

In a further embodiment the bush holder may be adapted to hold the body bush by means of a pneumatic vacuum cup, a vacuum shoe, gripper, a pneumatic gripper, an electric gripper or a magnet, as an alternative to the fork arrangement herein described, so that the body bush may be moved longitudinally whilst being retained in the bush pair holder.

In order to facilitate the alignment of the bush pair and the receptacle holder the and the opening and closing of the receptacle, the body bush and closure bush are provided with a corresponding chamfered surfaces, so that the bush and the receptacle holder can meet in a male/female arrangement.

According to an embodiment of the invention the receptacle and body bush may be weighed by a weighing system prior to being filled. This allows the system to determine whether a receptacle is present and/or whether a receptacle is damaged, for example if there is a hole in the capsule wall. A control system may be configured to operate the material dispenser only when the correct weight of receptacle is detected. In addition, the receptacle may be weighed by a weighing system during filling, this may enable the flow rate of the material dispenser to be altered during filling of the material, for example, the flow rate may be decreased as a predetermined target weight is approached.

In addition, the robotic arm may also be provided with a closure plate, generally mounted adjacent or above the bush pair holder, which facilitates the closure of the respectable after filling, providing a surface against which the receptacle can be abutted during re-closure of the receptacle.

The receptacle will generally be a hard or soft gelatin capsule. The capsule will usually be resiliently deformable so that the capsule can be opened and re-closed after filling.

According to a further aspect of the invention there is provided the use of an apparatus herein described for filling a receptacle, such as a hard or soft gelatin capsule, with a consistent dose of material.

According to a yet further aspect of the present invention there is provided a method of filling a receptacle with a consistent dose of a material, wherein the method comprises the steps of:

(i) filling a reservoir with an amount of material (ii) operating a receptacle handling unit comprising a receptacle bush pair, to collect a receptacle from a receptacle reservoir; and (iii) separating the receptacle into two parts and means for transporting one part of the receptacle to a filling station filling station adjacent the material reservoir (28);

(iv) aligning the receptacle with a filler nozzle;

(v) filling the receptacle with the material;

(vi) transporting the filled receptacle from the filling station to a unit for reclosing the receptacle closure; and (vii) means for dispensing the filled receptacle from the bush.

Figure 2:
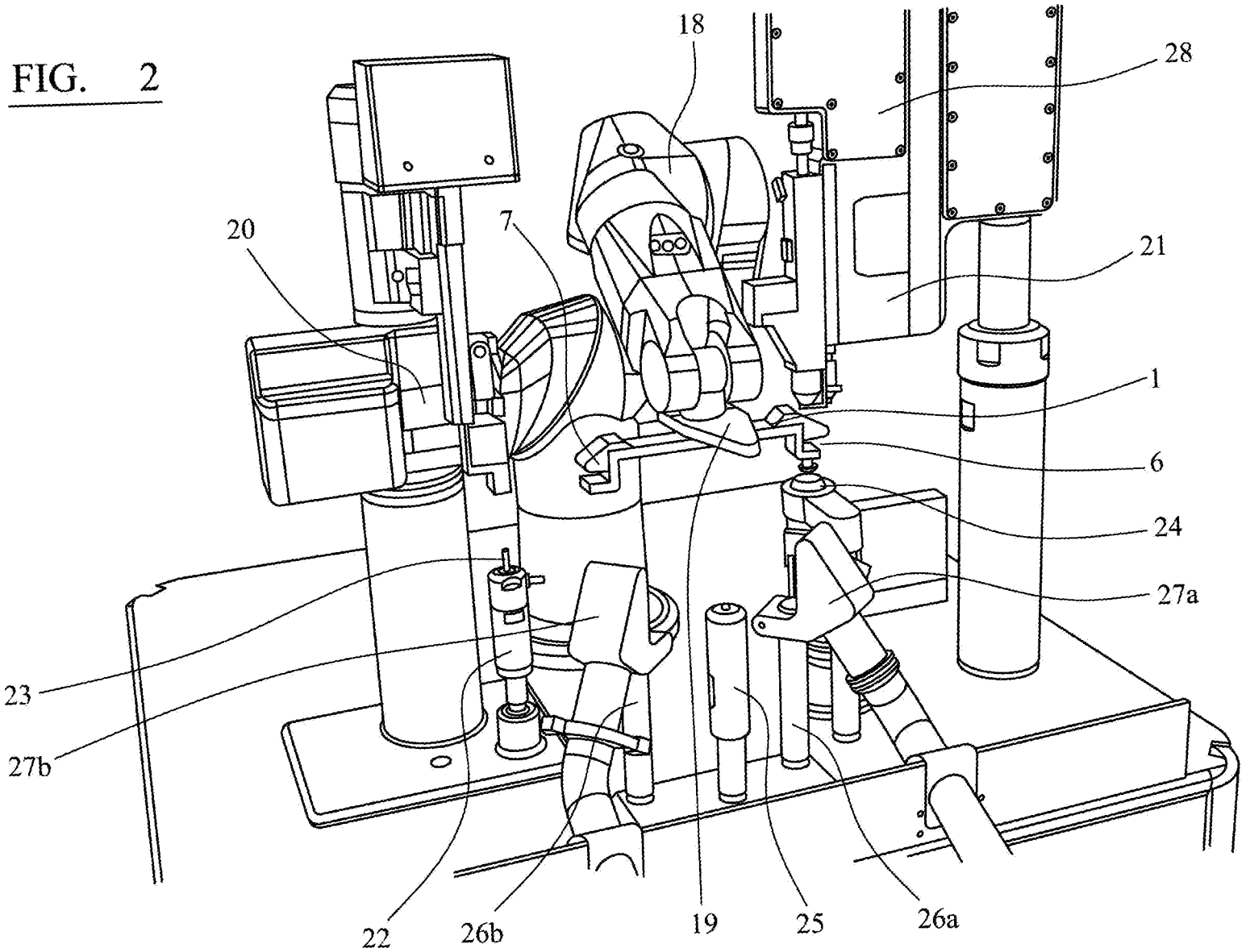

The invention will now be illustrated by way of example only and with reference to the accompanying figures in which:

FIG. 1 is a cross-sectional view of the extension arm with bushes attached; and FIG. 2 is schematic representation of the filling apparatus.

Referring to FIG. 1, apparatus for filling a material into a receptacle comprises a robotic arm (1) operably linked to a robot wrist (2). The robotic arm (1) is adapted to rotate about a spindle (3). At each end (4 and 5) of the robotic arm (1) is located bush pair handling systems (6 and 7). Each of the bush pair handling systems (6 and 7) comprises a securely located closure bush (8 and 9) and a detachably located body bush (10 and 11). Closure bushes (8 and 9) rest in respective forks (12 and 13) in extension limbs (14 and 15).

Bush pair handling system (6) is in the "open" position, in which a receptacle (capsule) (16) is shown to be separated into a capsule body (16*a*) and a capsule closure (16*b*). The capsule body (16*a*) is located in the body bush (10) and the capsule closure (16*b*) is located in the closure bush (8).

Bush pair handling system (7) is in the "closed" position, in which a receptacle (capsule) (17) is shown as a conjoined unit. The body bush (11) and the closure bush (9) are shown having been brought together; the capsule (17) is closed and urged into the closure bush (9), ready for transfer to means for segregating compliant receptacles from non-compliant receptacles, e.g. a weigh cell (not shown).

Referring to FIG. 2, apparatus for filling a material into a receptacle is shown comprising a robotic arm (1) connected to a robot (18). Between the robotic arm (1) and the robot (18) is a closure plate (19). Bush pair handling systems (6 and 7) are shown at the respective ends (4 and 5) of the robotic arm (1).

The apparatus is provided with a capsule dispenser (20) and a filling system/material dispenser (21). The capsule dispenser is provided with a detachment column (22), said column (22) being provided with a bush locator spindle (23). A weigh cell (24) is located adjacent the filling system/material dispenser (21), generally below the bush pair handling system (6).

A recoupling pillar (25) is also provided. The apparatus also includes ejection posts (26*a* and 26*b*) adjacent a pair of hoppers (27*a* and 27*b*) for dispatching compliant (27*a*) and non-compliant (27*b*) capsules (not shown).

In use the robotic arm (1) delivers a bush pair handling system (6) to a detachment column (22) of the capsule dispenser (21) and locates the closure bush (8) and body bush (10) about the bush locator spindle (23).

The capsule dispenser (21) dispenses a capsule (17) from the dispenser (21) into the bushes (8/10). The robotic arm 1 then depresses the bush (8/10) against the detachment column (22) urging the capsule closure (16*b*) into the corresponding closure bush (8), when pressure is released by the robotic arm (1), the closure bush (8) and the body bush (10) separate, leaving the capsule closure (16*b*) in the closure bush (8) and the capsule body (16*a*) in the body bush (10). The capsule body (16*a*) is then ready for filling.

The robotic arm (1) then collects the body bush (10) containing the capsule body (16*a*) and transfers it to the weigh cell (24) at the filling system/station (21). The capsule body (16*a*) is then filled to a gravimetrically predetermined amount and the robotic arm (1) retrieves the body bush (10) and delivers the body bush (10) and the closure bush (8) to the recoupling pillar (25). At the recoupling pillar (25) the robotic arm (1) depresses the bushes (8/10) between the recoupling pillar (25) and the closure plate (19). urging the body bush (10) and the closure bush (8) together, thus recoupling the capsule body (16*a*) and capsule closure (16*b*).

The robotic arm (1) then delivers the bushes (8/10) to one of the ejection posts (26*a*) or (26*b*), whereby the filled and recoupled capsule (17) is ejected into either the compliant hopper (27*a*) or non-compliant hopper (27*b*).

Providing a bush pair handling system (6 and 7) at each end (4 and 5) of the robotic arm (1) enables the robot (18) to continually process capsules, i.e. collecting another capsule whilst one capsule is being filled.

The invention claimed is:

1. An apparatus for filling a material into a receptacle, said apparatus comprising:

(i) a material reservoir for containing an amount of the material to be filled and a filling station adjacent the material reservoir;

(ii) a receptacle handling unit comprising a pair of axially aligned bushes for collecting a receptacle from a receptacle reservoir, wherein the receptacle comprises a receptacle body and receptacle closure; and (iii) a bush pair handling system comprising:

(a) a means for separating the receptacle into a receptacle body and a receptacle closure, said means comprising a pair of mating bushes provided with axially aligned bores, wherein the mating bushes are capable of independently handling the receptacle body and receptacle closure by being separated into a body bush and closure bush;

(b) means for temporarily attaching and detaching the one or both of the bushes from the bush pair handling system;

(c) automated means for transporting the receptacle body to the filling station and aligning the receptacle body with a filler nozzle at the filling station, wherein said automated means comprises a robotic arm adapted to rotate about a spindle, wherein said robotic arm is provided with at least one bush holder which is aligned with at least one receptacle holder, such that, the bush holder and the receptacle holder are capable of being separated, in order to open the receptacle and/or re-associated enabling the receptacle to be reclosed;

(d) the robotic arm is provided with a rotatory shaft rotatably connected to an extension arm, such that the extension arm is provided with a bush pair holder and receptacle holder at each end;

(e) means for transporting the filled receptacle body from the filling station to a closure unit for refitting the receptacle closure; and (f) means for segregating compliant receptacles from non-compliant receptacles;

wherein the body bush is designed to be held in the bush pair holder so that the body bush may be moved longitudinally whilst being retained in the bush pair holder; and wherein the bush pair holder is adapted to hold the body bush by means of a pneumatic vacuum cup, a vacuum shoe, a pneumatic gripper, an electric gripper or a magnet.

2. Apparatus according to claim 1 wherein the material to be filled into the receptacle is a liquid or a solid particulate material.

3. Apparatus according to claim 2 wherein the material to be filled into the receptacle is a solid particulate material in the form of powder, granules or pellets.

4. Apparatus according to claim 1 wherein the receptacle is a gelatin capsule.

5. Apparatus according to claim 1 wherein the dose of material to be filled into the receptacle is measured gravimetrically or volumetrically.

6. Apparatus according to claim 5 wherein the dose of material to be filled into the receptacle is measured gravimetrically using real time weigh cell.

7. Apparatus according to claim 6 wherein the dose of material to be filled into the receptacle is measured using real time weight control comprising the steps of:

a) dispensing powder from a doser comprising a powder doser, a weighing device and a control system configured to dispense a predetermined amount of powder into a receptacle positioned on the weighing device;
b) weighing the powder in the receptacle with the weighing device; and
c) ceasing dispensing powder when a predetermined weight has been reached.

8. Apparatus according to claim 1 wherein the pair of mating bushes comprises a male bush and a female bush.

9. Apparatus according to claim 8 wherein the male bush is the body bush and the female bush is the closure bush.

10. Apparatus according to claim 1 wherein the means for segregating compliant receptacles from non-compliant receptacles comprises positioning the filled receptacle (in its body bush) on a weigh cell.

11. Apparatus according to claim 10 wherein the weigh cell is capable of determining whether a receptacle is compliant or non-compliant; and transporting the body bush containing the receptacle adjacent to a respective hopper where the receptacle is ejected from the body bush into a compliance hopper or non-compliance hopper as appropriate.

12. Apparatus according to claim 1 wherein the means for transporting the receptacle to and from a filling station is automated comprising a robotic arm which is remotely controlled and/or computer controlled.

13. Apparatus according to claim 12 wherein the robotic arm is provided with a plurality of bush holders and receptacle holders.

14. Apparatus according to claim 13 wherein the robotic arm is capable of visiting more than one filling site.

15. Apparatus according to claim 13 wherein the robotic arm is provided with a closure plate mounted adjacent or above the receptacle holder, which facilitates the closure of the respectable after filling, providing a surface against which the receptacle closure can be abutted during reclosure of the receptacle.

16. A method of filling a receptacle with a consistent dose of a material, wherein the method comprises the steps of:

(i) filling a reservoir with an amount of material;
(ii) operating a receptacle handling unit comprising a receptacle bush pair, to collect a receptacle from a receptacle reservoir; and
(iii) separating the receptacle into two parts and automated means for transporting one part of the receptacle to a filling station adjacent the material reservoir—and aligning the receptacle with a filler nozzle wherein said automated means comprises a robotic arm adapted to rotate about a spindle, wherein said robotic arm is provided with at least one bush holder which is aligned with at least one receptacle holder, such that, the bush holder and the receptacle holder are capable of being separated, in order to open the receptacle and/or re-associated enabling the receptacle to be reclosed, wherein the robotic arm is provided with a rotatory shaft rotatably connected to an extension arm, such that the extension arm is provided with a bush pair holder and receptacle holder at each end;
(v) filling the receptacle with the material;
(vi) transporting the filled receptacle from the filling station to a unit for reclosing the receptacle closure; and
(vii) means for dispensing the filled receptacle from the bush;

wherein the body bush is designed to be held in the bush pair holder so that the body bush may be moved longitudinally whilst being retained in the bush pair holder; and wherein the bush pair holder is adapted to hold the body bush by means of a pneumatic vacuum cup, a vacuum shoe, a pneumatic gripper, an electric gripper or a magnet.

17. The method according to claim 16 wherein the dose of material to be filled into the receptacle is measured gravimetrically or volumetrically.

18. The method according to claim 17 wherein the dose of material to be filled into the receptacle is measured gravimetrically using a real time weigh cell.

19. The method according to claim 18 wherein the dose of material to be filled into the receptacle is measured using real time weight control, wherein said real time weight control comprises the steps of:

a) dispensing powder from a doser comprising a powder doser, a weighing device and a control system configured to dispense a predetermined amount of powder into a receptacle positioned on the weighing device;
b) weighing the powder in the receptacle with the weighing device; and
c) ceasing dispensing powder when a predetermined weight has been reached.

20. The method according to claim 16 wherein the means for transporting the receptacle to and from a filling station is automated and comprises a robotic arm which is remotely controlled and/or computer controlled wherein the robotic arm is provided with a closure plate mounted adjacent or above the receptacle holder, which facilitates the closure of the respectable after filling, providing a surface against which the receptacle can be abutted during re-closure of the receptacle.

* * * * *